US010799417B1

(12) United States Patent
Carr

(10) Patent No.: US 10,799,417 B1
(45) Date of Patent: Oct. 13, 2020

(54) MASSAGE DEVICE AND METHOD OF USE

(71) Applicant: Daniel Edward Carr, Los Angeles, CA (US)

(72) Inventor: Daniel Edward Carr, Los Angeles, CA (US)

( * ) Notice: Subject to any disclaimer, the term of this patent is extended or adjusted under 35 U.S.C. 154(b) by 0 days.

(21) Appl. No.: 16/690,031

(22) Filed: Nov. 20, 2019

(51) Int. Cl.
*A61H 7/00* (2006.01)
*A41D 19/00* (2006.01)

(52) U.S. Cl.
CPC ..... *A61H 7/003* (2013.01); *A41D 19/0024* (2013.01); *A61H 7/001* (2013.01); *A41D 2400/322* (2013.01); *A61H 2201/0153* (2013.01); *A61H 2201/1253* (2013.01)

(58) Field of Classification Search
CPC ..... A61M 7/001; A61M 7/003; A61H 2201/1253; A61H 2201/0153; A41D 19/0024; A41D 2400/322; A63B 71/146
USPC ..... 2/161.1, 161.2
See application file for complete search history.

(56) References Cited

U.S. PATENT DOCUMENTS 6,006,358 A * 12/1999 Keating ..... A63B 71/148 2/161.1
6,279,164 B1 * 8/2001 Martin ..... A41D 19/01552 2/161.1
7,707,654 B1 * 5/2010 Spence ..... A61H 7/003 2/161.6
10,383,378 B1 * 8/2019 Ptah ..... A61H 7/007
2008/0216207 A1 * 9/2008 Tsai ..... A61H 23/0263 2/160
2013/0245366 A1 * 9/2013 Rhodes ..... A61H 19/30 600/38
2014/0066925 A1 * 3/2014 Howard ..... A61H 23/00 606/38
2016/0113834 A1 * 4/2016 Bring ..... A61H 7/001 601/134
2017/0142931 A1 * 5/2017 Michaelson ..... A46B 5/04

* cited by examiner

*Primary Examiner* — Colin W Stuart
*Assistant Examiner* — Douglas Y Sul
(74) *Attorney, Agent, or Firm* — Cohen IP Law Group, P.C.; Michael N. Cohen

(57) ABSTRACT

A massage handwear system including handwear with outward extending ridges is provided. The handwear may be worn on the hands of the massage therapist while administering a massage. The outward extending ridges are configured in the palm areas, the fingertip areas and/or the thumb areas of the handwear and are usable to apply pressure to the recipient of the massage. Some of the outward extending ridges on a first handwear are adapted to engage with other outward extending ridges on a second handwear to configure the first and second handwear as a two-hand handwear assembly.

16 Claims, 14 Drawing Sheets

MASSAGE DEVICE AND METHOD OF USE

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to massage tools, including handwear with mechanical elements.

BACKGROUND

Muscular scar tissue adhesions are a direct cause of structural chronic pain. However, the scar tissue is very difficult to break down using one's bands or other body parts (e.g., during a body massage). For example, significant pointed downward (e.g., "cross-fiber") pressure must be applied to the scar tissue, and the current technique of applying this pressure using one's thumb(s) and/or fingertips is difficult to sustain and may cause damage to the hands of the massage therapist, possibly prematurely ending the therapist's career.

Massage tools currently on the market include handles with flat surfaces and vibrating instruments. However, these do not allow the massage therapist to apply targeted cross-fiber pressure with their hands as necessary to break down the scar tissue and to lengthen the associated peripheral nerves. In addition, the tools are not able to grip the individual muscles (or groups of muscles) as necessary for the breakdown of the scar tissue adhesions. Also, the tools are designed for a single hand application with no possibility of increasing pressure by using both hands in unison for enhanced cross-fiber friction and nerve lengthening.

Accordingly, there is a need for a massage tool that allows for the massage therapist to use his/her hands during the massage while reducing the subsequent strain inflicted on his/her thumbs and/or fingertips. There is also a need for a hand tool that includes ridges that may be used to grip the recipient's muscles as necessary for the elimination of scar tissue adhesions through cross-fiber friction and for the lengthening of associated peripheral nerves. There is also a need for a tool that configures the therapist's hand together to provide accurate two-handed pressure for these techniques.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

Figure 1:
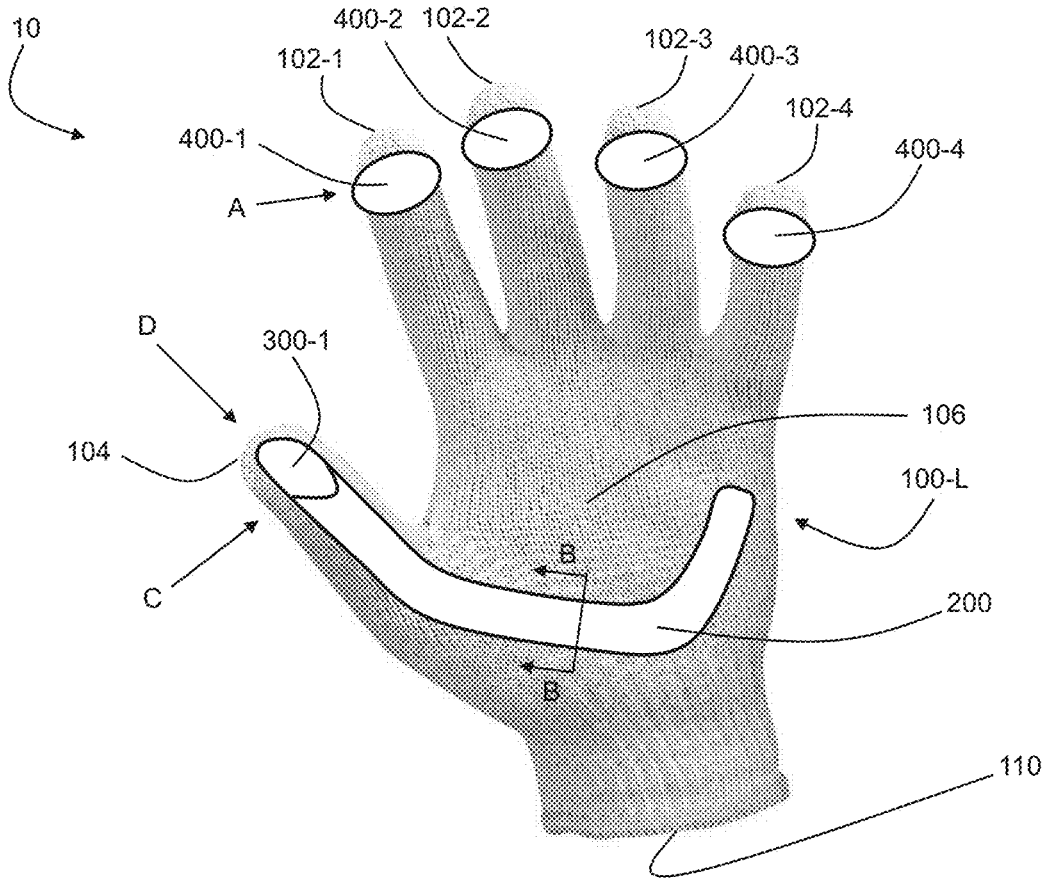
FIGS. 1-2 show aspects of a massage device according to exemplary embodiments hereof.

In general, the device and method according to exemplary embodiments hereof includes a massage tool for the manipulation of bodily tissues and nerves for therapeutic and/or relaxation purposes, and the tool's method of use thereof.

In some embodiments, the device includes handwear that may generally include one or more coverings designed to be worn on a person's hand(s). The handwear may include a left handwear, a right handwear and/or a left and right handwear combination. As described herein, the handwear may include novel mechanical elements that may facilitate the performance of particular types of bodily massage techniques when worn.

In some embodiments, each handwear may resemble a standard glove that may be worn on the wearer's hand and that may include four single-finger portions, a thumb portion and a palm/backside portion. However, it is understood that each glove may include other configurations including (without limitation) duel-finger portions (e.g., portions that may contain two fingers instead of a single finger), three-finger portions, four-finger portions (e.g., mittens), other types of configurations and any combination thereof. The handwear may comprise knitted material, rubber, other types of materials and any combination thereof.

In some embodiments, the right and left handwear may match (e.g., may be mirrored) while in other embodiments the right and left handwear may differ in their structural configuration and/or mechanical elements that each handwear may include.

For the purposes of this specification, the device will be described as a glove (or a combination of left and right gloves). However, it is understood by a person of ordinary skill in the art that the device may include any type(s) of handwear (including but not limited to those types described above) and that the scope of the device is not limited in any way by the configuration(s) of the handwear that the device may include.

In general, a person performing particular types of bodily massage techniques may wear the gloves during the application of the massage. The gloves may include underside ridges adapted to physically contact the bodily tissues and nerves to be massaged. In some embodiments, the underside ridges are positioned in the palm area, the finger area and/or the thumb area. During use, downward and crossward pressure may be applied to the ridges by the user's palm, fingers and thumb. In this way, the device may be used to facilitate the massage.

In some embodiments, the left and right gloves may be used together in combination to form a two-hand massage handwear assembly.

Further details of the device, as well as the device's methods of use will be described in detail below. The following detailed description is not intended to limit the current invention. Alternate embodiments and variations of the subject matter described herein will be apparent to those of ordinary skill in the art.

Referring now to FIGS. 1-14, the device 10 according to exemplary embodiments hereof will be described in further detail. Where the same or similar components appear in more than one figure, they are identified by the same or similar reference numerals.

Figure 2:
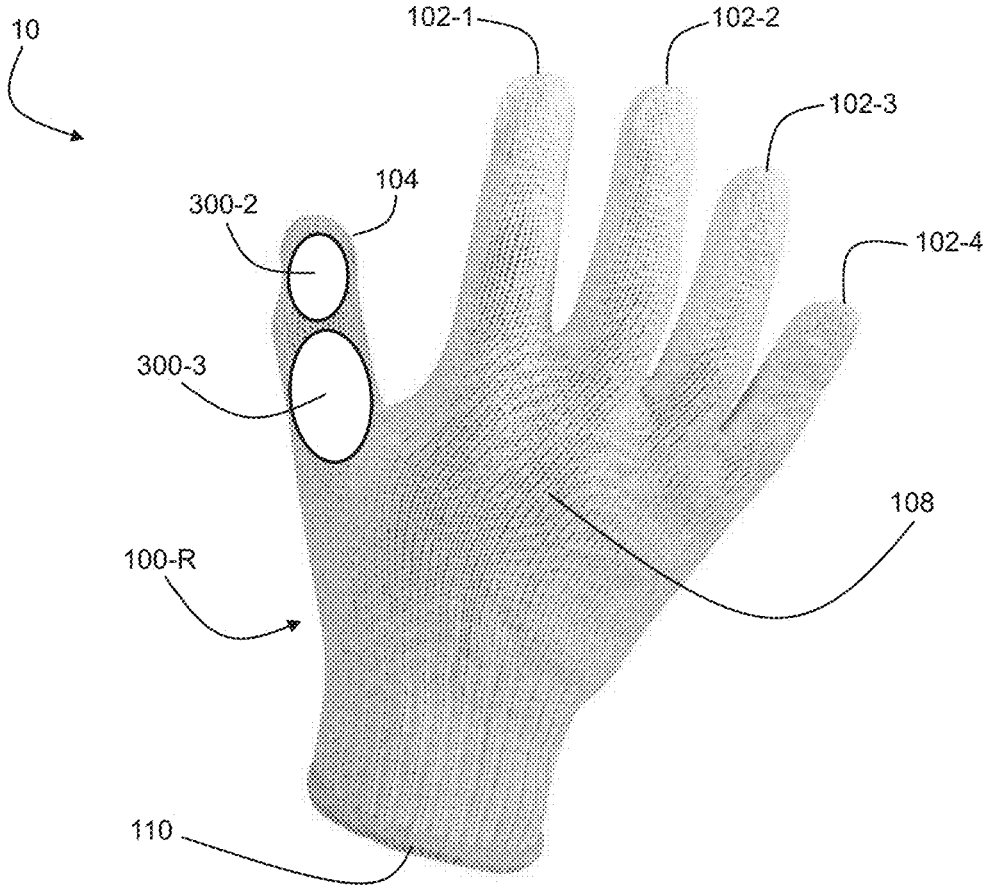

In one exemplary embodiment as shown in FIGS. 1 and 2, the device 10 may include a glove 100 with palm elements 200, thumb elements 300 and finger elements 400.

The glove 100 may include a left glove 100-L, a right glove 100-R and/or a left and right glove combination 100-LR. In addition, each glove 100 may include a plurality of finger portions 102-1, 102-2, . . . **102-*n* (individually and collectively 102) adapted to receive the finger(s) of the user, a thumb portion 104 adapted to receive the thumb of the user, a palm portion 106 adapted to receive the palm of the user, a back hand portion 108 (back of the hand) adapted to receive the back of the hand of the user and a wrist portion 110 adapted to receive the wrist of user. Note that not all gloves 100 are required to include all portions 102, 104, 106, 108, 110 or all elements 200, 300, 400. In general, the palm portion 106 may define the underneath portion of the glove 100 and the back hand portion 108 may define the top portion of the glove 100**.

The palm elements 200 may include one or more palm element(s) 200-1, 200-2, . . . **200-*n* (individually and collectively 200), the thumb elements 300 may include one or more thumb element(s) 300-1, 300-2, . . . 300-*n* (individually and collectively 300) and the finger elements 400 may include one or more finger element(s) 300-1, 300-2, . . . 300-*n* (individually and collectively 300). In some embodiments the palm elements 200 and the thumb elements 300 may be joined (as shown in FIG. 1) while in other embodiments the elements 200, 300 may be distinct and not joined. In some embodiments the thumb elements 300-2, 300-3 may be joined while in other embodiments the thumb elements 300-2, 300-3 may be distinct and not joined (as shown in FIG. 2**).

Each glove 100 may include one or more of the elements 200, 300, 400 and it is not required that each glove include all of the elements 200, 300, 400. It also is understood that two gloves 100 used in combination (e.g., a left glove 100-L and a right glove 100-R) may or may not match regarding the elements 200, 300, 400 that each glove 100-L, 100-R may or may not include. The device 10 also may include other elements and/or components that may be necessary for the device 10 to perform its desired functionalities as described in this specification.

For the purposes of this specification, FIG. 1 generally represents the underneath side of the glove 100-L (when worn) and FIG. 2 generally represents the top side of the glove 100-R (when worn).

Figure 3:
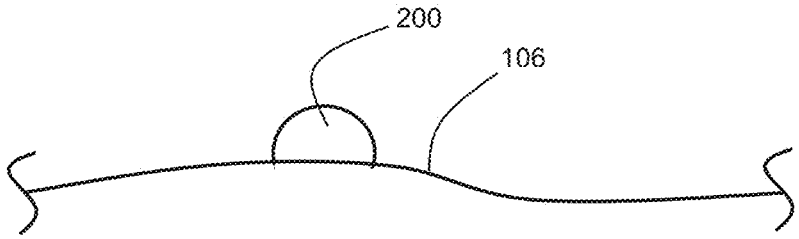
FIGS. 3-10 show aspects of massage device elements of the massage device of FIGS. 1-2 according to exemplary embodiments hereof.
Figure 4:
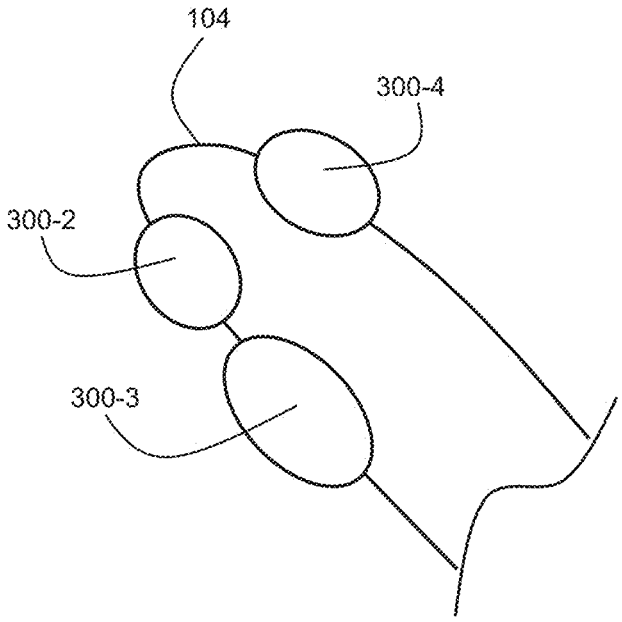
Figure 5:
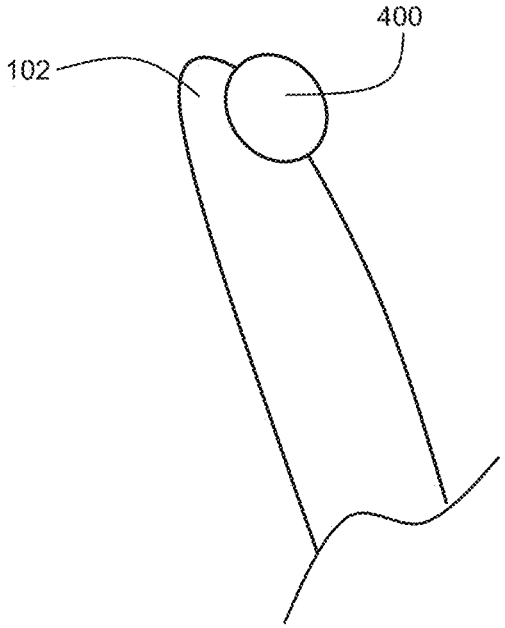

In general, the elements 200, 300 and 400 may comprise raised portions (e.g., ridges, ribs, etc.) in various locations on the glove 100 that may each extend from the surface of the glove 100 outward. For example, FIG. 3 depicts the palm element 200 of FIG. 1 (looking along cut-Lines B-B) extending outward from the underneath side of the palm 106 portion. In another example, FIG. 4 depicts the thumb element 300-1 (looking in the direction of arrow C in FIG. 1) extending outward from the underneath side of the distal end of the thumb 104 and the thumb elements 300-2, 300-3 (shown in FIG. 2 on the right glove 100-R) extending outward from the top side of the distal end of the thumb 104. In another example, FIG. 5 depicts the finger element 400-1 of FIG. 1 (looking in the direction of arrow A of FIG. 1) extending outward from the underneath side of the distal end of the finger 102-1.

Returning to FIG. 1, in one implementation, the palm element 200 extends across the lower portion of the palm portion 106 from the right side of palm portion 106 (as viewed in FIG. 1) to the left side of the palm portion 106. In some implementations, the palm element 200 extends a distance up the base of the thumb portion 104 as shown. In some implementations, the palm element 200 extends up the thumb portion 104 to the thumb element 300-1. In some implementations, the palm element 200 extends upward on the right side (as viewed in FIG. 1) from the lower portion of the palm portion 106 towards the upper portion of the palm portion 106 (towards the finger portions 102). As shown, in this implementation, the palm element 200 may form a generally U-shaped arc or contour. It is understood that the configurations, shapes and contours of the palm element 200 described above are meant for demonstrational purposes and that the palm element 200 may have any types of configurations, shapes and/or contours (linear, curved, etc.) and that the scope of the system 10 is not limited in any way by the configuration, shape and/or contour of the palm element 200.

In one implementation, the thumb element 300-1 generally covers the underside of the distal end portion of the thumb portion 104 (e.g., 0.75"-1.0" in width across the width of the thumb portion 104 and 0.5"-0.75" in length along the length of the thumb portion 104). However, it is understood that the thumb element 300-1 may be any size as required by the system 10.

In one implementation, the finger elements 400 each generally cover the underside of the distal end portion of each respective finger portion 102 (e.g., 0.5"-0.75" in width across the width of each respective finger portion 102 and 0.25"-0.75" in length along the length of each respective finger portion 102). However, it is understood that the finger elements 400 may be any size as required by the system 10.

Note that the elements 300 and 400 shown in FIGS. 1-5 are depicted as generally oval or circular shaped to demonstrate the general location of the elements 300, 400, however, it is understood that the FIGS. 1-5 are not meant to depict the actual shapes and/or relative sizes of the elements 200, 300, 400. Instead, it is understood that the elements 200, 300, 400 may include any types of shapes of any sizes and any combinations of shapes of any sizes as required by each glove 100 to perform its functionalities.

The elements 200, 300, 400 may preferably be formed of silicon or other types of natural and/or synthetic rubber and may also be formed of other materials such as plastics, leather, synthetic leather, wood or other types of materials. Accordingly, the elements 200, 300, 400 may be molded, sculpted or otherwise manufactured, and then attached to the glove(s) 100. The elements 200, 300, 400 may be attached to the glove(s) using adhesive, sewn or using other attachment methods. Alternatively, the elements 200, 300, 400 may be formed integrally with one or more portions of the gloves 100 (e.g., co-molded). In addition, the elements 200, 300. 400 may be formed using the same materials and/or methods, but this is not required. It is understood that the elements 200, 300, 400 may be formed and configured with the glove(s) 100 using any sufficient technique and/or materials and that the scope of the system 10 is not limited in any way by the materials or the methods by which the elements 200, 300, 400 are formed.

Figure 6:
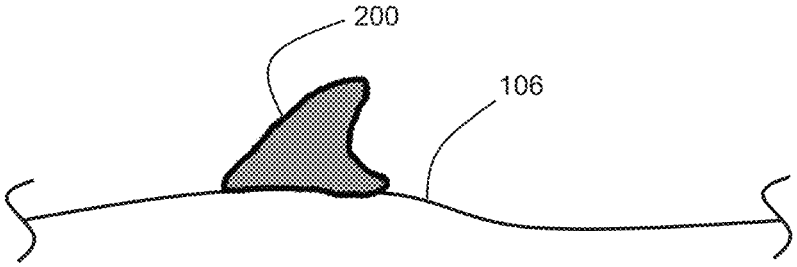

In one exemplary embodiment hereof as shown in FIG. 6, the palm element 200 may have a cross-sectional shape (looking in the direction of cut lines B-B in FIG. 1) that resembles a "shark fin" with the upper tip pointing generally towards the finger portions 102. In other embodiments, the cross-sectional shape of the palm element 200 may be triangular, trapezoidal, oval shaped or any other shape or combinations of shapes. In addition, the cross-sectional shape of the palm element 200 may vary in size and shape along the length of the palm element 200 (e.g., from left side of the palm element 200 to the right side of the palm element 200 in FIG. 1).

Figure 7:
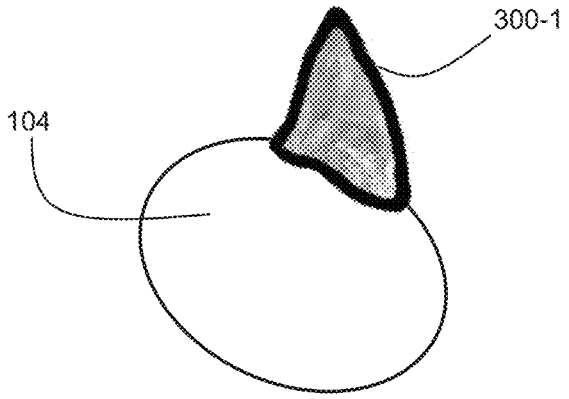

In one exemplary embodiment as shown in FIG. 7, the thumb element 300-1 may have a cross-sectional shape (looking in the direction of arrow D for the left glove 100-L of FIG. 1) that resembles a right triangle with the hypotonus generally facing outward and away from the palm portion 106 and the upward cathetus (leg) extending generally upward and towards the finger portions 102. In other embodiments, the cross-sectional shape of the thumb element 300-1 may resemble a "shark fin", may be trapezoidal, oval shaped or any other shape or combinations of shapes. In addition, the cross-sectional shape of the palm element 200 may vary in size and shape along the length of the thumb element 300-1 (e.g., from the distal end the thumb towards the proximal end of the thumb in FIG. 1).

Figure 8:
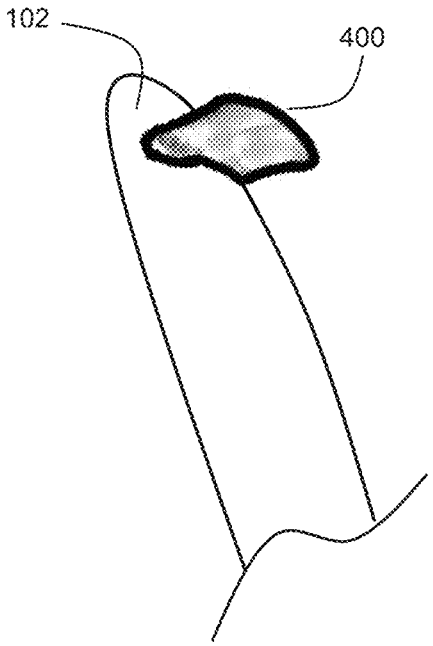

In one exemplary embodiment as shown in FIG. 8, a finger element 400 may have a cross-sectional shape (looking in the direction of arrow A for the left glove 100-L of FIG. 1) that resembles a "shark fin" with the upper tip pointing generally downwards toward the palm portion 106. In other embodiments, the cross-sectional shape of the finger element 400 may be triangular, trapezoidal, oval shaped or any other shape or combinations of shapes. In addition, the cross-sectional shape of each finger element 400-1-400-4 may be the same or similar or may vary from one finger element 400 to the next.

Combined Glove Assembly

In one exemplary embodiment hereof, a left glove 100-L and a right glove 100-R may be configured together to form a combined glove assembly 100-C. In general, the combined glove assembly 100-C may include one glove 100 (e.g., right glove 100-R) configured on top of a second glove 100 (e.g., left glove 100-L) and secured or generally held in place. In this general configuration, downward pressure from the upper glove 100 may be applied to the lower glove 100 during the administration of the massage to the recipient. This additional downward pressure provided by the upper glove 100 may increase the overall pressure that may be applied during the massage. In addition, by configuring the gloves 100 together, the cumulative pressure may be applied more precisely and with more control.

Figure 9:
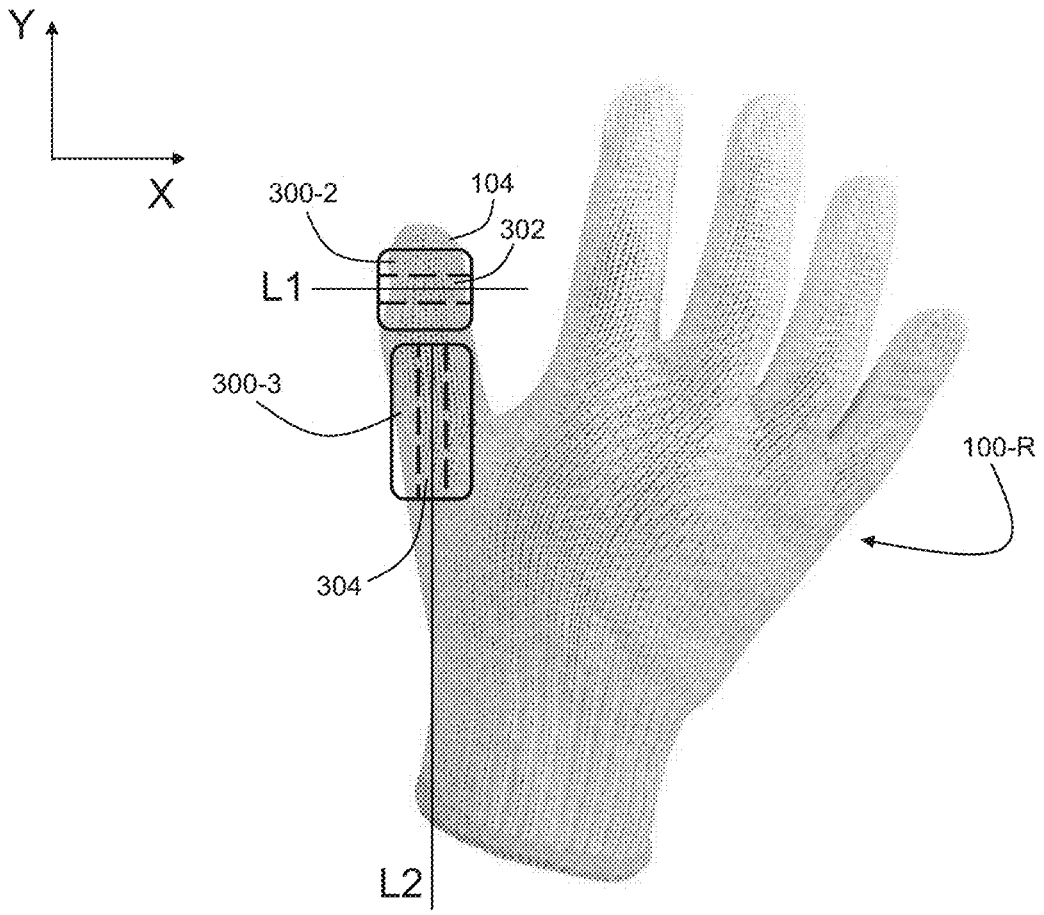
Figure 10:
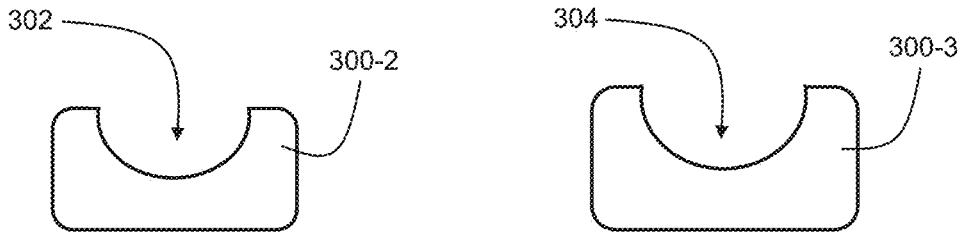

In one exemplary embodiment hereof, the thumb elements 300-2 and 300-3 may facilitate the configuring of a left glove 100-L and a right glove 100-R together to form a combine glove 100-C. As shown in FIGS. 9 and 10, element 300-2 may include an upper mechanism 302 and element 300-3 may include upper mechanism 304. Upper mechanisms 302, 304 may each include an upper channel or slot. Note that while the mechanisms 302 and 304 are described as slots or channels, it is understood that mechanisms 302, 304 may include other types of structures that may be used to perform similar functionalities. For example, the mechanisms 302, 304 may include holes, posts, grooves or other types of mechanisms that may facilitate the engagement of the thumb portion 300-1 with the thumb elements 300-2, 300-3 as described herein. For example, if the mechanisms 302, 304 include posts, the thumb elements 300-2, 300-3 may include corresponding holes to receive the posts.

Figure 11:
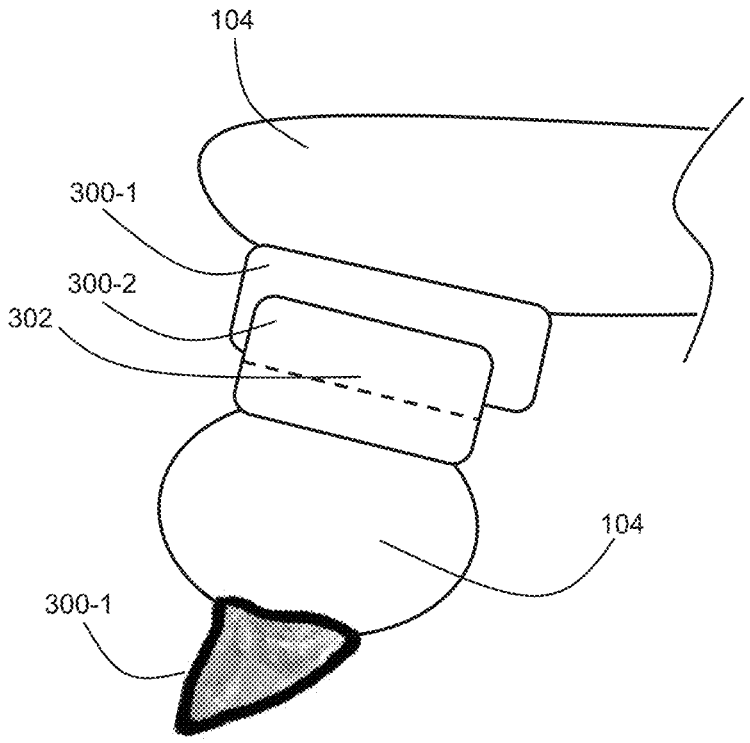
FIGS. 11-12 show aspects of a first combined massage device assembly according to exemplary embodiments hereof.

In one exemplary embodiment hereof as shown in FIG. 11, the slot 302 of a first glove 100 (e.g., left glove 100-L) is adapted to receive and secure the thumb element 300-1 of a second glove 100 (e.g., right glove 100-R) to form a combined glove assembly 100-C1. Accordingly, the slot 302 may have a size and shape that may generally correspond to the size and cross-sectional shape of the thumb element 300-1 (e.g., triangular, shark fin shape or any shape that may accommodate the thumb element 300-1). In some embodiments, the thumb element 300-1 may simply rest within the slot 302, while in other embodiments, the thumb element 300-1 may be held within the slot 302 (e.g., by pressure fit, detents, etc.). In any event, it is preferable that the thumb element 300-1 may be received and secured within the slot 302, and subsequently removed from the slot 302, without excessive force. It is also preferable that the thumb element 300-1 be generally holdable within the slot 302 while in use.

Figure 12:
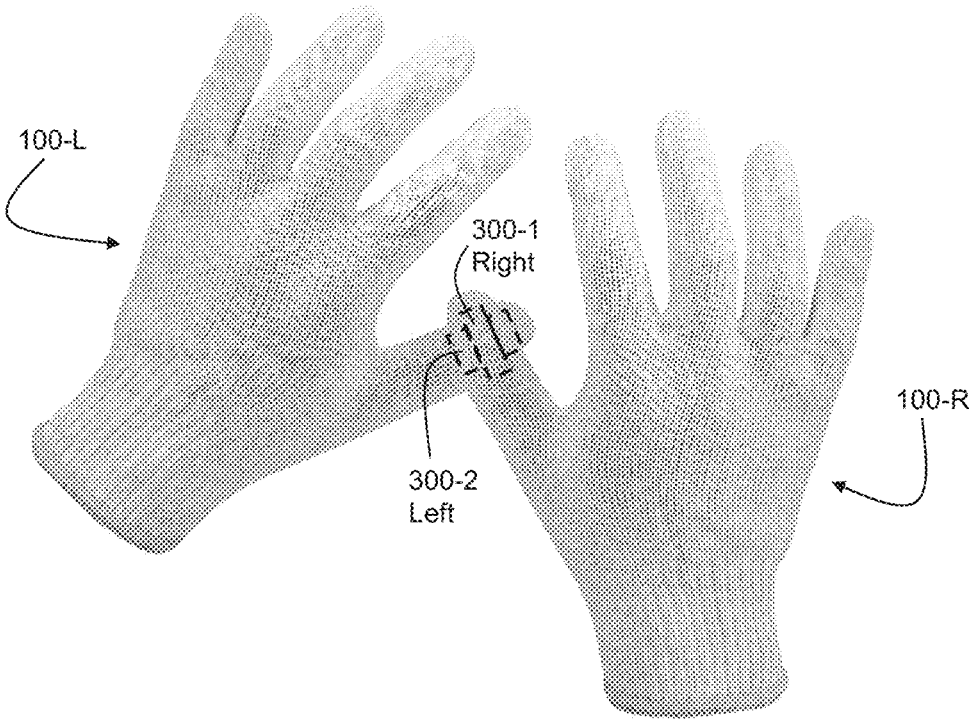

FIG. 12 shows the general hand placement to achieve this configuration of the thumb element 300-1 of the right glove 100-R configured within the slot 302 of the thumb element 300-2 of the left glove 100-L. Note that FIG. 12 is meant for demonstrational purposes and that the left and right gloves 100-L, 100-L may be placed in any configuration with respect to one another as required to configure the thumb element 300-1 with the thumb element 300-2.

When using the combined glove assembly 100-C1, downward pressure is provided by the upper glove 100 (e.g., right glove 100-R) via its thumb element 300-1 to the lower glove 100 (e.g., left glove 100-L) via its thumb element 300-2. In this way, additional downward force (cumulative from both gloves 100) may be applied to the recipient via the lower glove's thumb element 300-1 without fatiguing the hands (specifically the thumbs) of the masseuse.

In one embodiment, the orientation of the longitudinal length (along L1 of FIG. 9) of the slot 302 with respect to the X-Y axis of FIG. 9 is chosen to optimize the hand placement required to achieve this configuration. For example, the longitudinal orientation (L1) of the slot 302 may be generally parallel to the X-axis of FIG. 9. However, it is understood that the orientation of L1 may be chosen to place the slot 302 in any orientation as required by the combination 100-C1.

Figure 13:
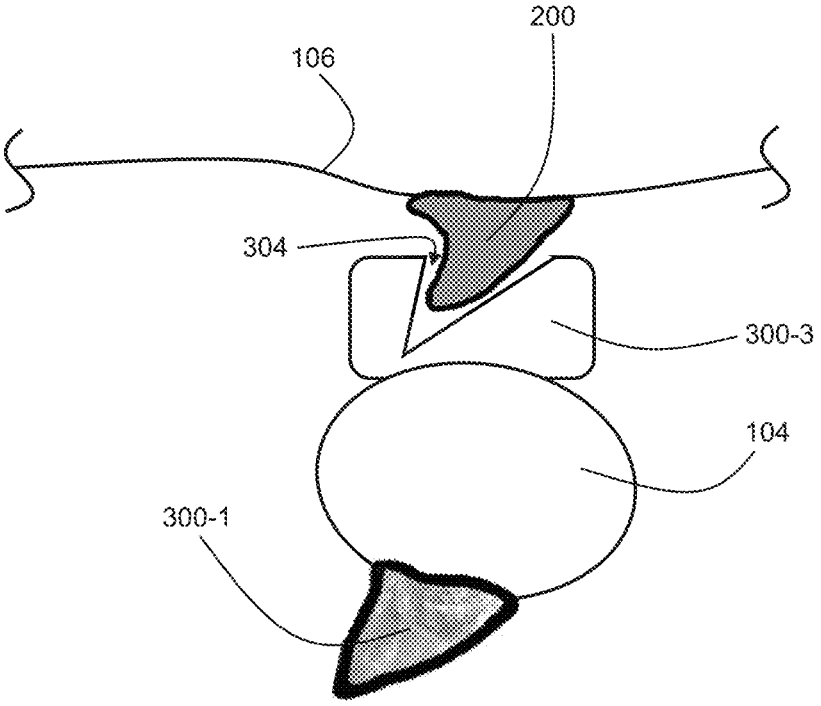
FIGS. 13-14 show aspects of a second combined massage device assembly according to exemplary embodiments hereof.

In one exemplary embodiment hereof as shown in FIG. 13, the slot 304 of a first glove 100 (e.g., left glove 100-L) is adapted to receive and secure the palm element 200 of a second glove 100 (e.g., right glove 100-R) to form a combined glove assembly 100-C2. Accordingly, the slot 304 may have a size and shape that may generally correspond to the size and cross-sectional shape of the palm element 200 (e.g., the shark fin shape or any shape that may accommodate the palm element 200). In some embodiments, the palm element 200 may simply rest within the slot 302, while in other embodiments, the palm element 200 may be held within the slot 302 (e.g., by pressure fit, detents, etc.). In any event, it is preferable that the palm element 200 may be received and secured within the slot 304, and subsequently removed from the slot 304, without excessive force. It is also preferable that the palm element 200 be generally holdable within the slot 304 while in use.

Figure 14:
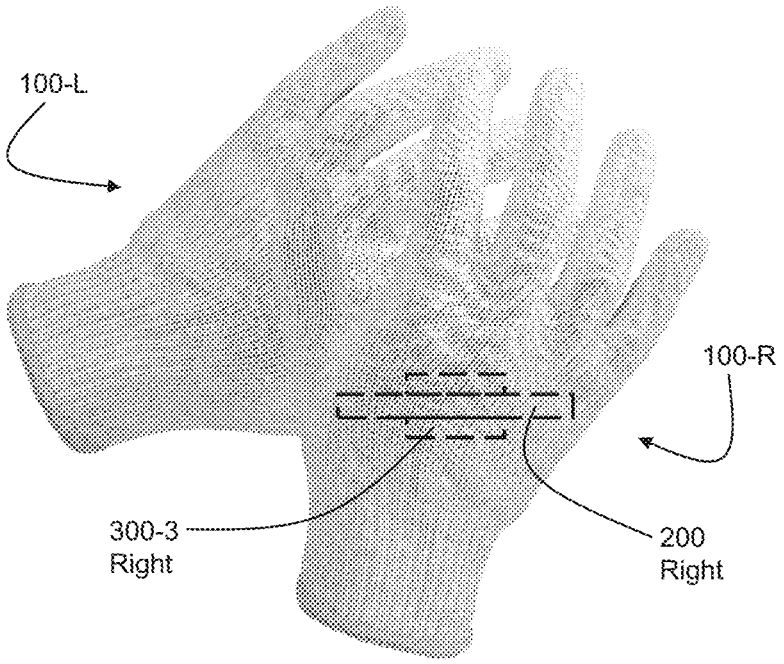

FIG. 14 shows the general hand placement to achieve this configuration of the palm element 200 of the right glove 100-R configured within the slot 304 of the thumb element 300-3 of the left glove 100-L. Note that FIG. 14 is meant for demonstrational purposes and that the left and right gloves 100-L, 100-L may be placed in any configuration with respect to one another as required to configure the palm element 200 with the thumb element 300-3.

When using the combined glove assembly 100-C2, downward pressure is provided by the upper glove 100 (e.g., right glove 100-R) via its palm element 200 to the lower glove 100 (e.g., left glove 100-L) via its thumb element 300-3. In this way, additional downward force (cumulative from both gloves 100) may be applied to the recipient via the lower glove's thumb element 300-1 and palm element 200 without fatiguing the hands (specifically the thumbs) of the masseuse. It may be preferable that the thumb element 300-3 extend a sufficient distance from the distal portion of the thumb portion 104 to the proximal portion of the thumb portion 104 (e.g., the base of the thumb portion 104) so that downward pressure exerted onto the thumb element 300-3 via the palm element 200 of the upper glove 100 is not only transferred to the lower glove's thumb element 300-1 but also to the lower glove's palm element 200. In some implementations the length of the thumb element 300-3 along the length of the thumb portion 104 is 0.50"-1.5". However, it is understood that the thumb element 300-3 may any length as required by the system 10.

In one embodiment, the orientation of the longitudinal length (along L2 of FIG. 9) of the slot 304 with respect to the X-Y axis of FIG. 9 is chosen to optimize the hand placement required to achieve this configuration. For example, the longitudinal orientation (L2) of the slot 304 may be generally parallel to the Y-axis of FIG. 9. However, it is understood that the orientation of L2 may be chosen to place the slot 304 in any orientation as required by the combination 100-C2.

In addition, as shown in FIGS. 12 and 14, the offsetting of the combined gloves 100-L, 100-R may facilitate the proper orientations of the user's left and right arm, hands and thumbs while using the combined glove assemblies 100-C1 and 100-C2. For example, it may be preferable that the user's left radius bone be aligned generally parallel to the user's left thumb (the thumb's metacarpal, proximal phalange and medial phalange, and the user's right radius bone may be aligned generally parallel to the user's right thumb (the thumb's metacarpal, proximal phalange and medial phalange. In addition, the user's left radius bone and left thumb may be offset from the user's right radius bone and right thumb by an appropriate angle $\phi$. By properly orientating the user's left and right radius bones and thumbs, the user's arms and hands may provide stable downward pressure to the combined glove assemblies 100-C1, 100-C2 while in use while minimizing stress to the user's arms and hands. In some embodiments, the angle $\phi$ may be about 90°. In other embodiments, the angle $\phi$ may be 45°, 50°, 60°, 70°, 80°, 90°, 100°, 110°, 120°, 130°, 135° and other angles. It is understood that the angle $\phi$ may be any angle as required to place the first and second gloves 100 at ergonomic angles for use.

In some embodiments hereof, the elements 200, 300, 400 may be generally linear with constant widths along their lengths. In other embodiments, the elements 200, 300, 400 may include curvatures or varying widths along their lengths. In other embodiments, some of the elements 200, 300, 400 may be linear with constant widths along their lengths while other elements 200, 300, 400 may include curvatures or varying widths along their lengths. For example, some of the elements 200, 300, 400 may include an arc shape.

In some embodiments, the elements 200, 300, 400 extend outward from the surface of the glove(s) 100 distances of 1/16"-3/16", 1/32"-1/8", 1/8"-1/4", 1/4"-1/2", or other distances. However, it is understood that the elements 200, 300, 400 may extend any distances as required. It is also understood that the elements 200, 300, 400 may extend outward differing distances and that the distances any of the elements extend outward need not match.

In Use

Whether used in unison or individually, the elements 200, 300, 400 (when gloves 100 are worn) are designed to provide cross-fiber friction to the massage recipient's muscles, thereby breaking scar tissue adhesions and lengthening peripheral nerves.

In one exemplary embodiment hereof, the elements 200, 300, 400 (when gloves 100 are worn) may contact, grip, secure and then rake the muscle fibers (using a back-and-forth motion). This action may create cross-fiber friction that eradicates scar tissue adhesion while lengthening and/or elongating associated nerves. In this way, the elements 200, 300, 400 may act as cross fiber elements 200, 300, 400. The scar tissue is broken between the muscles, tendons, ligaments and nerves and peripheral nerves are lengthened away from the spinal cord. This action may break down scar tissue adhesions between the muscles and pull and lengthen peripheral nerves away from the spinal cord.

In one example, the elements 200, 300, 400 may be used individually for specialized tasks. For instance, the finger elements 400 may designed to penetrate between the bone and the muscle. In another example, the palm element 200 may be designed to penetrate and compress larger, bulkier muscles such as the massage recipient's "erector spinae".

In another example of use, the thumb element 300-1 is used to separate and wedge muscle from adjacent bone.

In another example of use, ridges 200, 300, 400 are used to perform deep tissue cuts into larger muscle groups as well as different maneuvers of nerve lengthening and scar tissue eradication.

In another example of use, the combined assembly 100-C may be used to exert additional downward pressure with higher precision (e.g., because the combined assembly 100-C is configured with both hands). In this way, the combined assembly 100-C may be used to perform deep tissue cuts on larger muscles as well as different nerve lengthening maneuvers and scar tissue eradication. In one example of this type, the assembly 100-C may be used to perform a 90-degree cut on the recipient's erector spine or the iliocostalis lumborum.

Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

I claim:

1. A massage device comprising:

a first handwear including a first thumb portion;

a first outward extending ridge configured with the first thumb portion;

a first channel configured with the first thumb portion generally opposite and perpendicular to the first outward extending ridge;

a second handwear including a second thumb portion; and a second outward extending ridge configured with the second thumb portion and adapted to engage the first channel; and a second channel configured with the first thumb portion generally opposite the first outward extending ridge and generally perpendicular to the first channel.

2. The massage device of claim 1 further comprising a first palm portion configured with the second handwear; and a third outward extending ridge configured with the first palm portion and adapted to engage the second channel.

3. The massage device of claim 2 further comprising a second palm portion configured with the first handwear; and a fourth outward extending ridge configured with the second palm portion.

4. The massage tool of claim 2 wherein the fifth outward extending ridge include a cross-section in the shape of a triangle.

5. The massage device of claim 1 further comprising at least one first finger portion configured with the first handwear; and a fifth outward extending ridge configured with the at least one first finger portion.

6. The massage tool of claim 5 wherein the fifth outward extending ridge include a cross-section in the shape of a triangle.

7. The massage tool of claim 5 wherein the fifth outward extending ridge is configured with an underside distal end of the first finger portion.

8. The massage tool of claim 1 further comprising at least one second finger portion configured with the second handwear; and a sixth outward extending ridge configured with the at least one second finger portion.

9. The massage tool of claim 1 wherein the first handwear includes a first glove and the second handwear includes a second glove.

10. The massage tool of claim 1 wherein the first outward extending ridge includes a cross-section in the shape of a triangle.

11. The massage tool of claim 1 wherein the first outward extending ridge is configured with an underside distal end of the first thumb portion.

12. A massage device comprising:

a first handwear including a first handwear top portion and a first handwear underneath portion opposite the top portion, a first thumb portion including a first thumb portion top portion generally coinciding with the first handwear top portion and a first thumb portion underneath portion generally coinciding with the first handwear underneath portion, and a first palm portion generally coinciding with the first handwear underneath portion;

a first channel configured with the first thumb portion top portion and generally extending from a proximal portion of the first thumb portion to a distal portion of the first thumb portion;

a second channel configured with the first thumb portion and extending general perpendicularly to the first channel;

a first outward extending ridge configured with the first palm portion;

a second handwear including a second palm portion; and a second outward extending ridge configured with the second palm portion and adapted to engage the first channel.

13. The massage device of claim 12 further comprising:

a second thumb portion configured with the second handwear;

a third outward extending ridge configured with the second thumb portion and adapted to engage the second channel.

14. The massage device of claim 12 further comprising a fourth outward extending ridge configured with the first thumb portion generally opposite the second channel.

15. A massage device comprising:

a first handwear including a first thumb portion, at least one first finger portion and a first palm portion;

a first outward extending ridge configured with a distal end of the first thumb portion and extending along an axis joining a proximal end of the thumb portion and the distal end of the thumb portion;

a first channel configured with the first thumb portion and generally extending from a proximal portion of the first thumb portion to a distal portion of the first thumb portion;

a second channel configured with the first thumb portion and extending generally perpendicular to the first channel; and a second outward extending ridge configured with the first palm portion and extending from a side of the palm portion adjacent a proximal end of the first thumb portion to a side of the palm portion opposite the side of the palm portion adjacent the proximal end of the first thumb portion.

16. The massage tool of claim 15 wherein the first outward extending ridge and/or the second outward extending ridge includes a cross-section in the shape of a triangle.

* * * * *